US009376192B2

(12) United States Patent
Saito et al.

(10) Patent No.: US 9,376,192 B2
(45) Date of Patent: Jun. 28, 2016

(54) TRIM AND TILT DEVICE AND MARINE VESSEL PROPELLING MACHINE

(71) Applicant: Showa Corporation, Gyoda-shi (JP)

(72) Inventors: Takahiko Saito, Haga-gun (JP); Hayato Tsutsui, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 0 days.

(21) Appl. No.: 14/513,909

(22) Filed: Oct. 14, 2014

(65) Prior Publication Data

US 2015/0274274 A1 Oct. 1, 2015

(30) Foreign Application Priority Data

Mar. 26, 2014 (JP) ..... 2014-063104

(51) Int. Cl.

| | |
|---|---|
| ***B63H 5/125*** | (2006.01) |
| ***B63H 20/08*** | (2006.01) |
| ***B63H 5/00*** | (2006.01) |
| ***F15B 15/14*** | (2006.01) |

(52) U.S. Cl.

CPC ..... *B63H 20/08* (2013.01); *B63H 5/00* (2013.01); *F15B 15/1423* (2013.01)

(58) Field of Classification Search

CPC ..... B63H 5/00; B63H 20/08; B63H 20/10; F15B 15/1423

USPC ..... 440/61 S

See application file for complete search history.

(56) References Cited

U.S. PATENT DOCUMENTS

| | | | | |
|---|---|---|---|---|
| 5,358,436 | A | 10/1994 | Soda et al. | |
| 2012/0073961 | A1 * | 3/2012 | Kagawa | B63H 20/10 204/196.3 |
| 2014/0199898 | A1 * | 7/2014 | Takase | B63H 20/10 440/63 |

FOREIGN PATENT DOCUMENTS

| | | | |
|---|---|---|---|
| JP | 04-005190 | A | 1/1992 |
| JP | 2012-071683 | A | 4/2012 |

* cited by examiner

*Primary Examiner* — Stephen Avila
(74) *Attorney, Agent, or Firm* — Leason Ellis LLP

(57) ABSTRACT

A trim and tilt device includes: a cylindrical cylinder; a partition member provided in contact with the cylinder so as to be movable in an axial direction of the cylinder and partitioning a space inside the cylinder; a rod member to which the partition member is attached on one end side of the rod member and which moves relatively in the axial direction of the cylinder together with the partition member thereby adjusting a tilt angle of a marine vessel propelling machine body with respect to a hull; and a rod guide member electrically connected to a sacrificial anode and having a hole so that the rod member passes through the hole, and the rod guide member has a conductive portion disposed at a position, where the hole is formed, so as to electrically connect the rod member and the rod guide member.

6 Claims, 13 Drawing Sheets

TRIM AND TILT DEVICE AND MARINE VESSEL PROPELLING MACHINE

CROSS-REFERENCE TO RELATED APPLICATIONS

This application is based on and claims priority under 35 USC 119 from Japanese Patent Application No. 2014-063104 filed on Mar. 26, 2014, the entire content of which is incorporated herein by reference.

BACKGROUND OF THE INVENTION

1. Field of the Invention

The present invention relates to a trim and tilt device and a marine vessel propelling machine.

2. Description of the Related Art

Conventionally, a device that extends and compresses a cylinder device connected between a hull and a marine vessel propelling machine body to thereby change the angle of the marine vessel propelling machine body with respect to the hull is proposed.

For example, Japanese Patent Application Publication No. 2012-71683 discloses an electric corrosion preventing structure for marine vessel propelling machines in which a cylinder is formed integrally with a cylinder block, an electric connection portion is provided in a portion of the cylinder to which a rod guide is fixed, an electric connection portion is provided in a portion of a rod to which a piston is fixed inside the cylinder, and the piston fixed to the rod abuts the rod guide in a state of being electrically connected to the rod guide when the rod protrudes from the cylinder up to its maximum extension.

Moreover, Japanese Patent Application Publication No. H4-5190 discloses a corrosion preventing mechanism for outboard motors in which a swivel case is supported on a stern bracket fixed to a hull so as to oscillate vertically, an outboard motor body is rotatably supported on the swivel case, a tilt cylinder device is disposed between the stern bracket and the swivel case, a first galvanic anode is provided below the outboard motor body, a second galvanic anode is provided in a submerged portion of the stern bracket, the first and second galvanic anodes are connected by a first electric connection circuit, a second electric connection circuit branches off from the first electric connection circuit, and the second electric connection circuit is connected to the tilt cylinder device.

Patent Document 1: Japanese Patent Application Publication No. 2012-71683

Patent Document 2: Japanese Patent Application Publication No. H4-5190

SUMMARY OF THE INVENTION

For example, when a marine vessel propelling machine is used in the sea, electric corrosion is likely to occur, in which metal used for the marine vessel propelling machine ionizes and melts down due to the seawater.

Due to this, a sacrificial anode formed from metal that ionizes easily is used. In this case, the sacrificial anode is electrically connected to respective portions of the marine vessel propelling machine so that the sacrificial anode corrodes preferentially. In this way, the occurrence of electric corrosion in other portions is suppressed.

However, it is difficult to electrically connect the sacrificial anode to the rod member (rod) of the trim and tilt device of the marine vessel propelling machine. Thus, electric corrosion is likely to occur in the rod member.

An object of the present invention is to provide a trim and tilt device or the like in which a sacrificial anode and a rod member are electrically connected with a simple configuration and in which electric field corrosion rarely occurs in the rod member.

A trim and tilt device according to the present invention includes: a cylindrical cylinder; a partition member provided in contact with the cylinder so as to be movable in an axial direction of the cylinder and partitioning a space inside the cylinder; a rod member to which the partition member is attached on one end side of the rod member and which moves relatively in the axial direction of the cylinder together with the partition member thereby adjusting a tilt angle of a marine vessel propelling machine body with respect to a hull; and a rod guide member electrically connected to a sacrificial anode and having a hole so that the rod member passes through the hole, wherein the rod guide member includes a conductive portion disposed at a position, where the hole is formed, so as to electrically connect the rod member and the rod guide member.

A marine vessel propelling machine according to the present invention is a marine vessel propelling machine, including: a marine vessel propelling machine body having a propeller; a sacrificial anode; and a trim and tilt device including: a cylindrical cylinder; a partition member provided in contact with the cylinder so as to be movable in an axial direction of the cylinder and partitioning a space inside the cylinder; a rod member to which the partition member is attached on one end side of the rod member and which moves relatively in the axial direction of the cylinder together with the partition member thereby adjusting a tilt angle of the marine vessel propelling machine body with respect to a hull; and a rod guide member in which a hole is formed so that the rod member passes through the hole, wherein the rod guide member of the trim and tilt device includes a conductive portion disposed at a position where the hole is formed so as to electrically connect the rod member, the rod guide member, and the sacrificial anode.

According to the present invention, it is possible to provide a trim and tilt device or the like in which a sacrificial anode and a rod member are electrically connected with a simple configuration and in which electric field corrosion rarely occurs in the rod member.

EXPLANATION OF REFERENCE NUMERALS

Figure 1A:
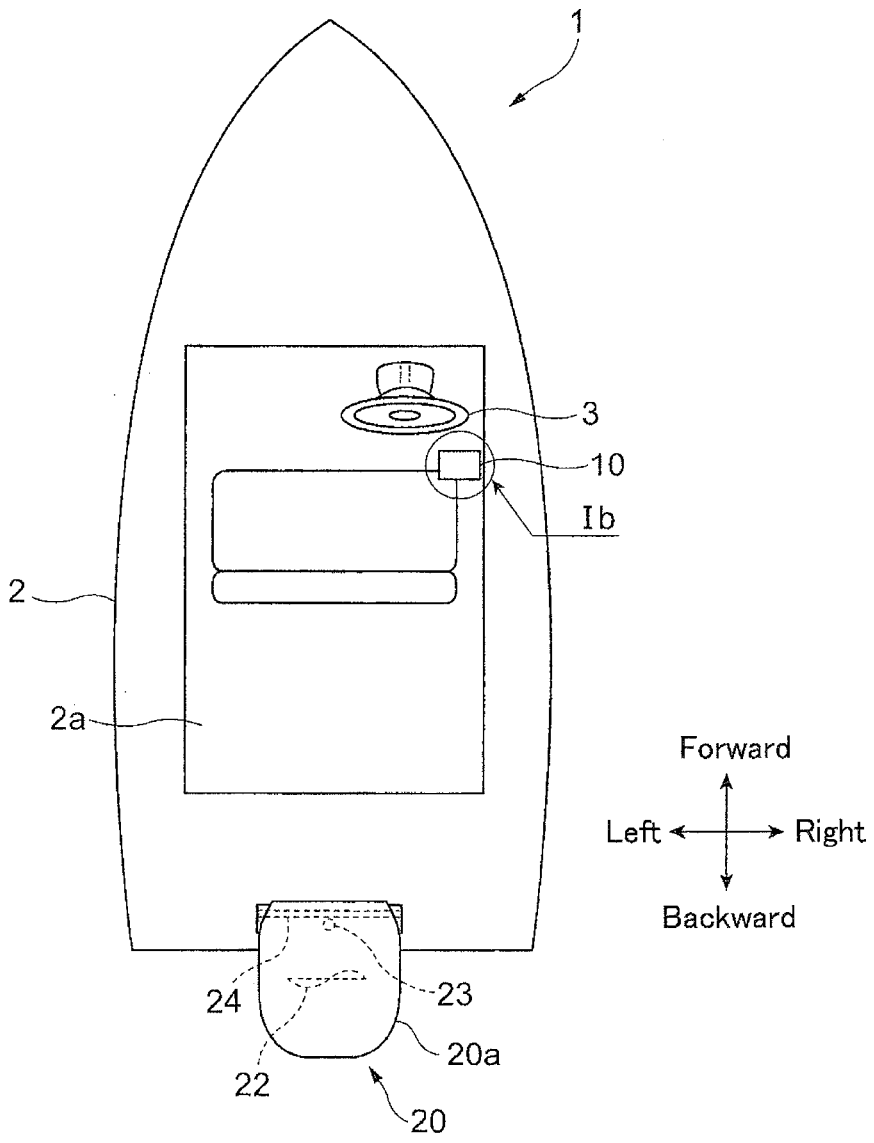
FIGS. 1A and 1B are schematic diagrams illustrating a configuration of a marine vessel according to the present embodiment.

1: Marine vessel
2: Hull
3: Handle
10: Remote control box
20: Marine vessel propelling machine
20*a*: Marine vessel propelling machine body
27: Sacrificial anode
30: Trim and tilt device
31: Cylinder device
32: Supply and discharge device
40: Tilt cylinder mechanism
41, 51, 141, 151: Cylinder
42, 52, 142, 152: Piston
43, 53, 143: Piston rod
44, 54, 144: Rod guide
44*d*, 54*d*, 144*d*: Bearing
50, 50*a*, 50*b*: Trim cylinder mechanism

DETAILED DESCRIPTION OF THE INVENTION

Hereinafter, embodiments of the present invention will be described in detail with reference to the accompanying drawings.

Figure 1B:
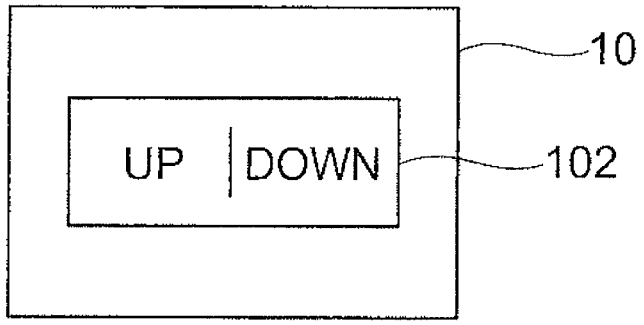

FIGS. 1A and 1B are schematic diagrams illustrating a configuration of a marine vessel 1 according to the present embodiment. FIG. 1A is a diagram when the marine vessel 1 is seen from the above. FIG. 1B is an enlarged view of a portion indicated by Ib of FIG. 1A. In the following description, an advancing direction in a forward travelling state of the marine vessel 1 will be referred to as a forward side, an advancing direction in a backward travelling state will be referred to as a backward side, a left side in the advancing direction will be referred to as a left side, and a right side in the advancing direction will be referred to as a right side.

A marine vessel 1 includes a hull 2, a wheel-shaped handle 3 that is rotatably attached to an instrument panel provided in a front portion of a cabin 2*a* provided in the hull 2, a remote control box 10 provided in a front right portion of the cabin 2*a*, and a marine vessel propelling machine 20 that applies propelling force to the hull 2.

A tilt angle adjustment switch 102 for adjusting a tilt angle θ (see FIG. 2) of the marine vessel propelling machine body 20*a* of the marine vessel propelling machine 20 with respect to the hull 2 is provided in the remote control box 10.

Next, the marine vessel propelling machine 20 will be described.

Figure 2:
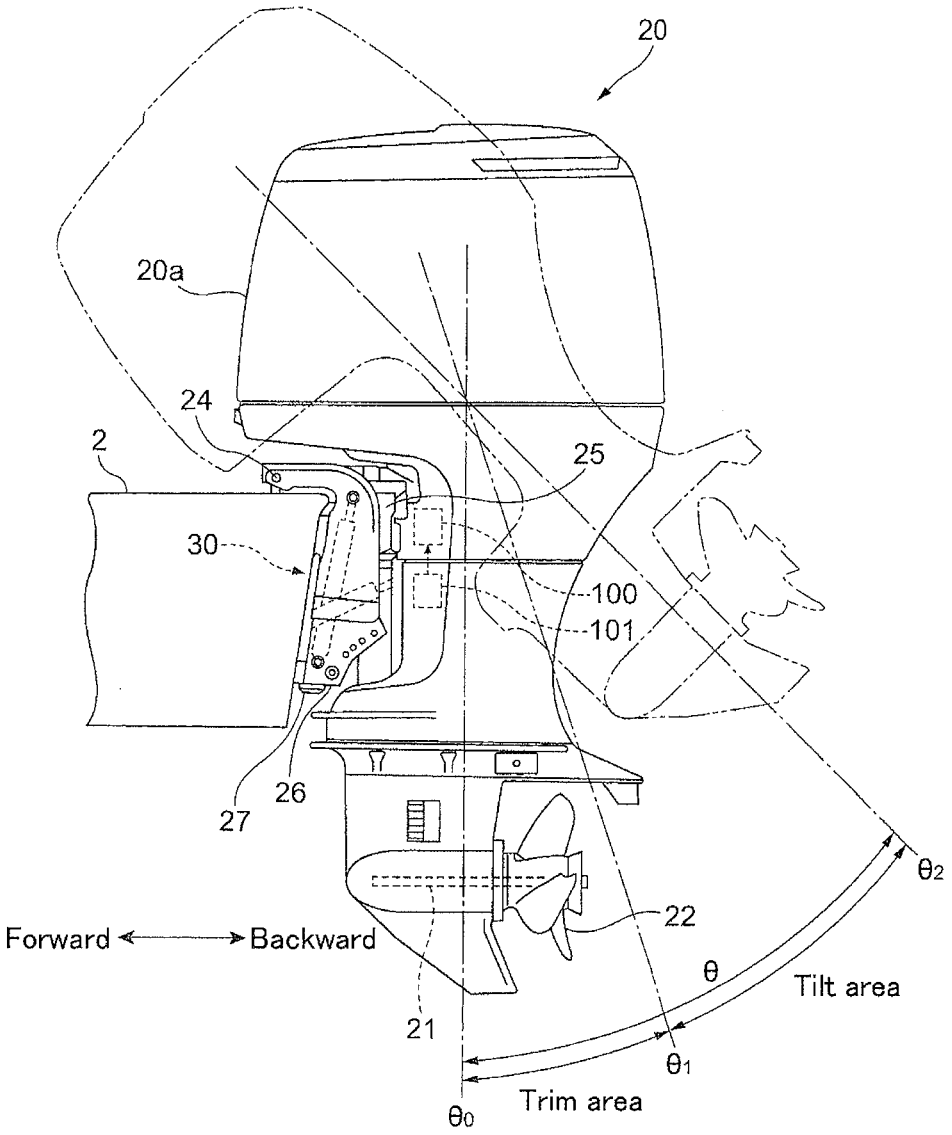
FIG. 2 is a schematic diagram illustrating a configuration of a marine vessel propelling machine.

FIG. 2 is a schematic diagram illustrating a configuration of the marine vessel propelling machine 20.

The marine vessel propelling machine 20 includes a marine vessel propelling machine body 20*a* that generates propelling force and a trim and tilt device 30 that adjusts the tilt angle θ.

The marine vessel propelling machine body 20*a* includes: an engine (not illustrated) positioned so that an axial direction of a crank shaft (not illustrated) is in a vertical direction (up-down direction) in relation to the water surface; a drive shaft (not illustrated) that is connected to a lower end of the crank shaft so as to rotate integrally with the crank shaft and extends vertically downward; a propeller shaft 21 connected to the drive shaft by means of a bevel gear mechanism, and a propeller 22 attached to a rear end of the propeller shaft 21.

Moreover, the marine vessel propelling machine body 20*a* includes a swivel shaft 23 (see FIGS. 1A and 1B) provided in the vertical direction (up-down direction), a horizontal shaft 24 provided in a horizontal direction in relation to the water surface, a swivel case 25 in which the swivel shaft 23 is rotatably accommodated, and a stern bracket 26 that connects the swivel case 25 to the hull 2.

Further, the marine vessel propelling machine body 20*a* includes a sacrificial anode 27 formed from metal in which electric corrosion is likely to occur. In the present embodiment, the sacrificial anode 27 is provided below the stern bracket 26 and is fixed to the stern bracket 26 by bolts.

The marine vessel propelling machine 20 is formed by many of components made from metal such as iron, aluminum, or aluminum alloys. Thus, when the marine vessel propelling machine 20 is used in the sea in particular, current flows through the seawater according to a potential difference generated between metals. Therefore, electric corrosion in which these metals ionize to melt down into the seawater is likely to occur. Thus, in the present embodiment, the sacrificial anode 27 formed from metal that is less likely to ionize than these metals is provided. The components formed from metal and the sacrificial anode 27 are electrically connected and the sacrificial anode 27 corrodes preferentially. In this way, the occurrence of electric corrosion in other components is suppressed.

Examples of metal that can be used in the sacrificial anode 27 include zinc (Zn), zinc alloys, magnesium (Mg), magnesium alloys, and the like.

Next, the trim and tilt device 30 will be described.

The trim and tilt device 30 includes a control device 100 that controls the operation of the trim and tilt device 30, a tilt angle sensor 101 that detects the tilt angle θ, and the tilt angle adjustment switch 102 (see FIGS. 1A and 1B) for adjusting the tilt angle θ.

The tilt angle sensor 101 may be an optical sensor that detects the distance between the rear end of the hull 2 and the marine vessel propelling machine body 20*a*, for example. Moreover, the tilt angle sensor 101 may have an optional configuration as long as it can detect the rotation angle of the swivel case 25 with respect to the stern bracket 26.

The tilt angle adjustment switch 102 is a seesaw switch of which the left and right portions can be pressed and the tilt angle θ increases when the left portion (UP side) is pressed and decreases when the right portion (DOWN side) is pressed.

The tilt angle θ includes a trim area and a tilt area.

In the trim area ($\theta_1$ to $\theta_1$), the tilt angle θ of the marine vessel propelling machine body 20*a* can be adjusted according to the posture of the marine vessel 1. That is, when the speed of the marine vessel 1 increases, the stem is raised and the propeller 22 is angled downward. In this case, the efficiency of the propelling force generated by the marine vessel propelling machine body 20*a* decreases. Thus, the tilt angle θ of the marine vessel propelling machine body 20*a* in the trim area is adjusted so that the propeller 22 is in the horizontal direction in relation to the water surface to thereby suppress a decrease in the efficiency of the propelling force.

Moreover, when the marine vessel propelling machine body 20*a* is tilted in the tilt area ($\theta_1$ to $\theta_2$), the marine vessel propelling machine body 20*a* is raised above the water surface (for example, the state depicted by two-dot chain lines in FIG. 2 where the tilt angle is $\theta_2$). By doing so, it is possible to suppress shellfish or the like from adhering the marine vessel propelling machine body 20*a* when the marine vessel 1 is at anchor and to make it difficult to damage the marine vessel propelling machine body 20*a*.

<First Embodiment>

Next, a specific configuration of the trim and tilt device 30 will be described in further detail. First, a first embodiment of the trim and tilt device 30 will be described.

Figure 3:
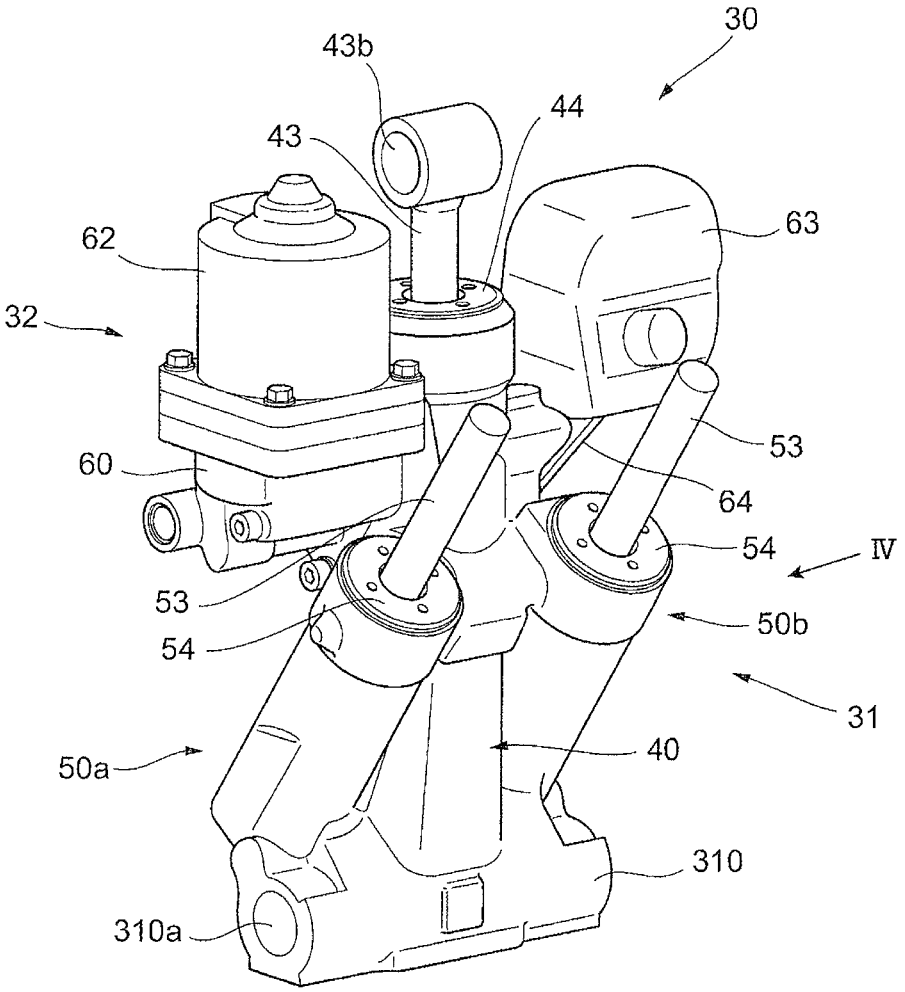
FIG. 3 is an external view of a trim and tilt device according to a first embodiment.

FIG. 3 is an external view of the trim and tilt device 30 according to the first embodiment.

The trim and tilt device 30 includes a cylinder device 31 that is connected between the swivel case 25 and the stern bracket 26 so as to be extended and compressed in order to change the distance therebetween and a supply and discharge device 32 that circulates hydraulic fluid in order to extend and compress the cylinder device 31.

First, the cylinder device 31 will be described.

The cylinder device 31 includes a tilt cylinder mechanism 40 for tilting the marine vessel propelling machine body 20*a* in the tilt area and a pair of trim cylinder mechanisms 50*a* and 50*b* for rotating the marine vessel propelling machine body 20*a* mainly in the trim area. As illustrated in FIG. 3, the tilt cylinder mechanism 40 and the trim cylinder mechanisms 50*a* and 50*a* are arranged in a line in the left-right direction. An arrangement in which the tilt cylinder mechanism 40 is disposed at the center and the trim cylinder mechanisms 50*a* and 50*b* sandwich the tilt cylinder mechanism 40 from the left and right sides is employed.

The cylinder device 31 includes a housing 310 that accommodates the tilt cylinder mechanism 40 and the trim cylinder mechanisms 50*a* and 50*b*.

Figure 4:
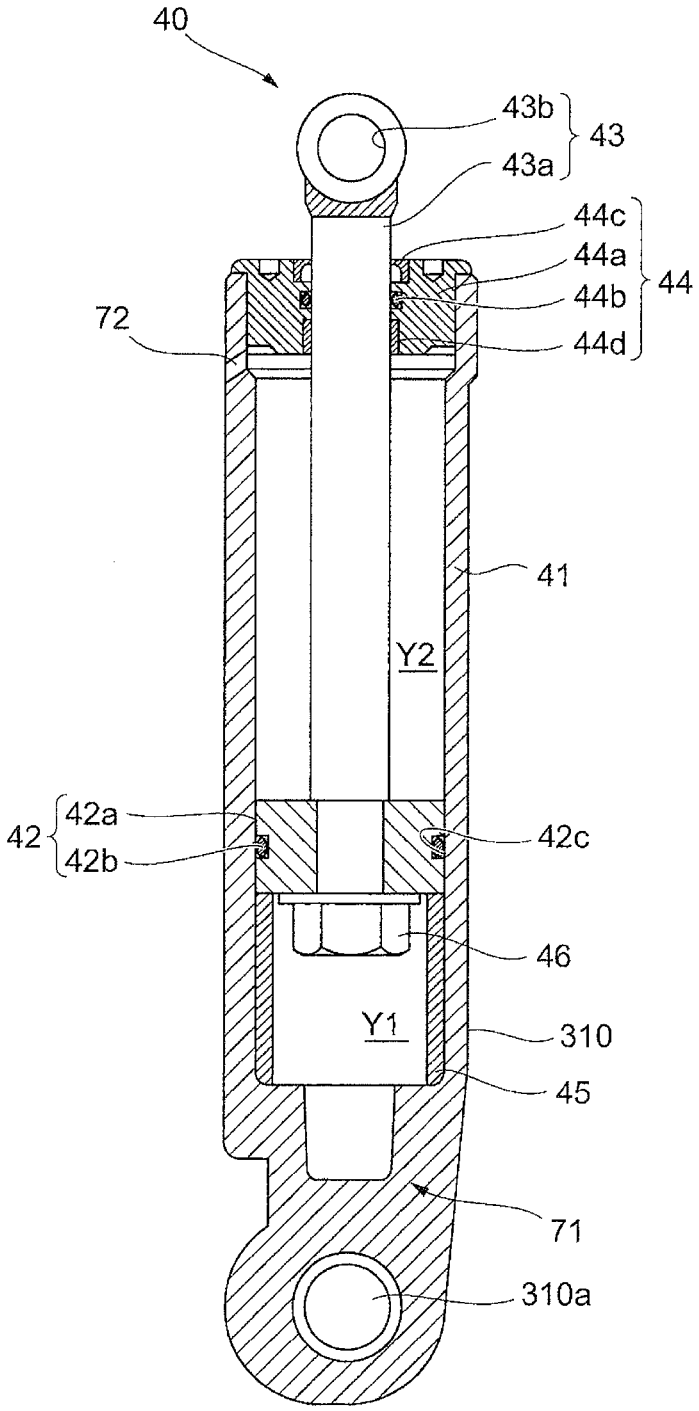
FIG. 4 is a cross-sectional view of a tilt cylinder mechanism when see from the direction IV in FIG. 3.

FIG. 4 is a cross-sectional view of the tilt cylinder mechanism 40 when seen from the direction IV in FIG. 3.

The tilt cylinder mechanism 40 is a cylindrical portion formed at a central portion in the left-right direction of the housing 310. The tilt cylinder mechanism 40 includes a bottomed cylinder 41 of which one end in the central line direction (the up-down direction in FIG. 4) of the cylindrical portion is blocked and which has an opening at the other end, a piston 42 inserted in the cylinder 41 so as to be movable in the central line direction, and a piston rod 43 which extends in the central line direction and to which the piston 42 is attached on one end side (the lower end in FIG. 4) in the central line direction. Moreover, the tilt cylinder mechanism 40 includes a nut 46 that supports the piston 42 together with a male screw formed at one end of the piston rod 43, a rod guide 44 disposed so as to block the opening on the other end side of the cylinder 41 and to guide the piston rod 43, and a cylindrical sleeve 45 for adjusting the stroke of the piston rod 43.

The piston 42 includes a cylindrical piston body 42*a* in which a hole is formed at a central portion so that the piston rod 43 passes through the hole and a sealing member 42*b* such as an O-ring provided on an outer circumference of the piston body 42*a*. A groove 42*c* depressed from an outer circumferential surface is formed on the entire outer circumference of the piston body 42*a*, and the sealing member 42*b* is fitted into the groove 42*c*. The piston 42 makes contact with the inner circumferential surface of the cylinder 41 and partitions an inner space of the cylinder 41 in which hydraulic fluid is enclosed into a first fluid chamber Y1 that is disposed closer to one end side in the central line direction than the piston 42 and a second fluid chamber Y2 that is disposed closer to the other end side in the central line direction than the piston 42. In this manner, the piston functions as an example of a partition member that is provided in contact with the cylinder 41 so as to be movable in the axial direction (central line direction) of the cylinder 41 to partition the inner space of the cylinder 41.

The piston rod 43 includes a columnar rod portion 43*a*, a male screw formed at one end in the central line direction of the piston rod 43 so as to attach the piston 42 thereto, and a pin hole 43*b* that supports a pin for connecting the piston rod 43 to the swivel case 25 is formed at the other end in the central line direction of the piston rod 43.

The piston rod 43 functions as a rod member to which the piston 42 is attached on one end side and which moves in the axial direction of the cylinder 41 together with the piston 42 in a relative manner to adjust the tilt angle θ of the marine vessel propelling machine body 20*a* with respect to the hull 2, which will be described in detail later.

The rod guide 44 includes an approximately cylindrical rod guide body 44*a* in which a hole is formed in a central portion so that the piston rod 43 passes through the hole, a sealing member 44*b* disposed in a central portion in the central line direction so as to make sliding contact with the piston rod 43, a water seal 44*c* disposed at the other end in the central line direction so as to suppress entrance of liquid such as water into the cylinder 41, and a bearing 44*d* which is an example of a conductive portion and is a conductive annular bush and which supports the piston rod 43.

A groove depressed from an inner circumferential surface is formed in the inner circumference of the rod guide body 44*a*, and the sealing member 44*b* is fitted into the groove. Moreover, a recess depressed from an end surface is formed in the other end of the rod guide body 44*a* in the central line direction, and the water seal 44*c* is fitted into the recess. Further, a recess depressed from the other end of the rod guide body 44*a* in the central line direction is formed in the inner circumference of the rod guide body 44*a*, and the bearing 44*d* is fitted into the recess. In this manner, the bearing 44*d* is disposed at a position where the hole of the rod guide 44 is formed. The bearing 44*d* will be described in further detail later.

The rod guide 44 functions as a rod guide member in which a hole is formed so that the piston rod 43 passes through the hole.

The sleeve 45 has a cylindrical shape and has a inner diameter that is smaller than the outer diameter of the piston body 42*a* of the piston 42. The sleeve 45 is disposed on one end side in the central line direction of the cylinder 41 so as to restrict movement of the piston 42 and the piston rod 43 toward one end side.

Figure 5:
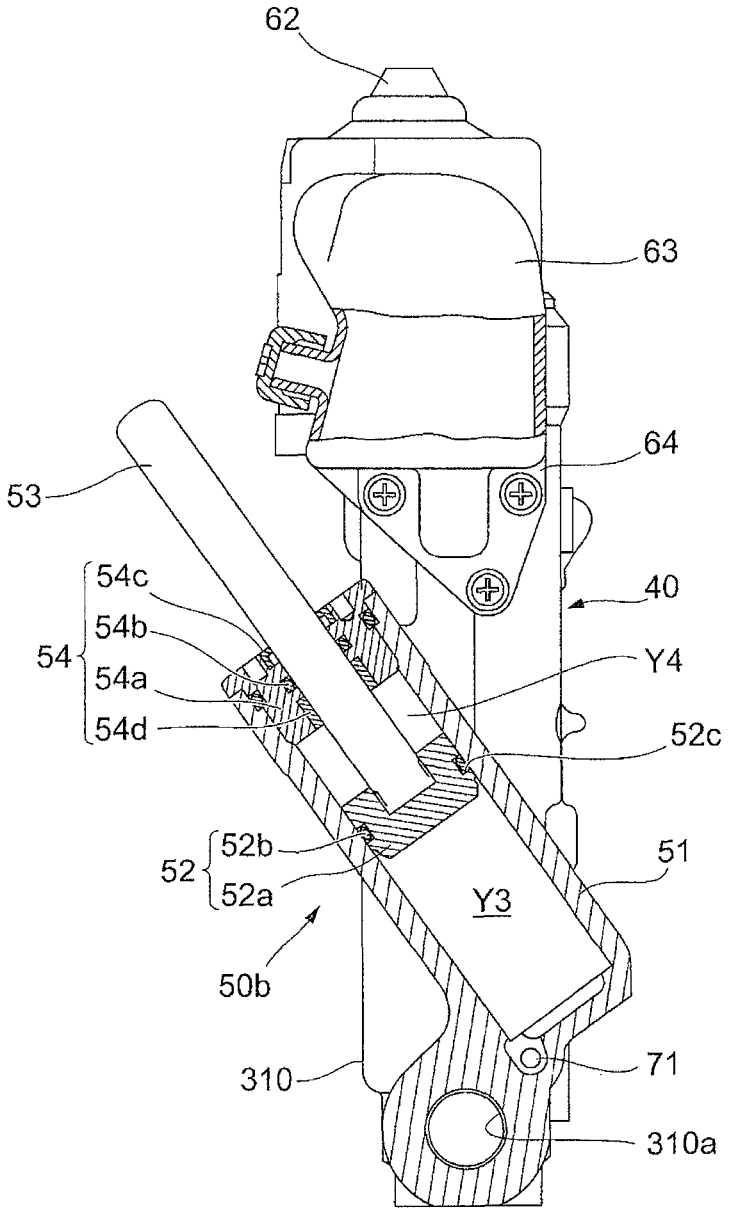
FIG. 5 is a cross-sectional view of a trim cylinder mechanism when seen from the direction IV in FIG. 3.

FIG. 5 is a cross-sectional view of the trim cylinder mechanism 50*b* when seen from the direction IV in FIG. 3.

The trim cylinder mechanisms 50*a* and 50*b* have the same structure. Thus, only the explanation on the trim cylinder mechanism 50*b* is provided as the explanation on the trim cylinder mechanism 50*a* is the same as that on the trim cylinder mechanism 50*b*. When the trim cylinder mechanisms 50*a* and 50*b* are not distinguished, both will be sometimes collectively referred to as a "trim cylinder mechanism 50".

The trim cylinder mechanism 50 is a cylindrical portion formed at a predetermined angle with respect to the central line direction of the cylinder 41 with the cylinder 41 interposed. The trim cylinder mechanism 50 includes a bottomed cylinder 51 of which one end of the cylindrical portion is blocked and which has an opening at the other end, a piston 52 inserted in the cylinder 51 so as to be movable in the central line direction of the cylinder 51, and a piston rod 53 which extends in the central line direction of the cylinder 51 and to which the piston 52 is attached on one end side (the lower end in FIG. 5) in the central line direction of the cylinder 51.

Moreover, the trim cylinder mechanism 50 includes a rod guide 54 disposed so as to block an opening on the other end side of the cylinder 51 and to guide the piston rod 53.

The piston 52 includes a cylindrical piston body 52*a* in which a hole is formed at a central portion so that the piston rod 53 passes through the hole and a sealing member 52*b* such as an O-ring provided on an outer circumference of the piston body 52*a*. A groove 52*c* depressed from an outer circumferential surface is formed on the entire outer circumference of the piston body 52*a*, and the sealing member 52*b* is fitted into the groove 52*c*. The piston 52 makes contact with the inner circumferential surface of the cylinder 51 and partitions an inner space of the cylinder 51 in which hydraulic fluid is enclosed into a third fluid chamber Y3 that is disposed closer to one end side in the central line direction than the piston 52 and a fourth fluid chamber Y4 that is disposed closer to the other end side in the central line direction than the piston 52. The piston 52 functions as an example of a partition member similarly to the piston 42.

The piston rod 53 includes a male screw formed at one end in the central line direction of the cylinder 51 so as to attach the piston 52 thereto. The piston rod 53 functions as an example of a rod member similarly to the piston rod 43.

The rod guide 54 includes an approximately cylindrical rod guide body 54*a* in which a hole is formed in a central portion so that the piston rod 53 passes through the hole, a sealing member 54*b* disposed in a central portion in the central line direction of the cylinder 51 so as to make sliding contact with the piston rod 53, a water seal 54*c* disposed at the other end in the central line direction of the cylinder 51 so as to suppress entrance of liquid such as water into the cylinder 51, and a bearing 54*d* which is an example of a conductive portion and is a conductive annular bush and which supports the piston rod 53.

A groove depressed from an inner circumferential surface is formed in the inner circumference of the rod guide body 54*a*, and the sealing member 54*b* is fitted into the groove. Moreover, a recess depressed from an end surface is formed in the other end of the rod guide body 54*a* in the central line direction of the cylinder 51, and the water seal 54*c* is fitted into the recess. Further, a recess depressed from the other end of the rod guide body 54*a* in the central line direction of the cylinder 51 is formed in the inner circumference of the rod guide body 54*a*, and the bearing 54*d* is fitted into the recess. In this manner, the bearing 54*d* is disposed at a position where the hole of the rod guide 54 is formed. The bearing 54*d* will be described in further detail later. The rod guide 54 functions as an example of a rod guide member similarly to the rod guide 44.

The housing 310 includes the cylinders 41 and 51 in an integrated manner, and further includes a motor support portion 60 and a tank chamber support portion 64 which are described later in an integrated manner. A channel which is a flow path of hydraulic fluid is formed around the cylinders 41 and 51, the motor support portion 60, and the tank chamber support portion 64, which will be described later. A pin hole 310*a* that supports a pin for connecting the trim and tilt device 30 to the stern bracket 26 is formed at one end of the housing 310 in the central line direction of the cylinder 41.

Next, the supply and discharge device 32 will be described.

Figure 6:
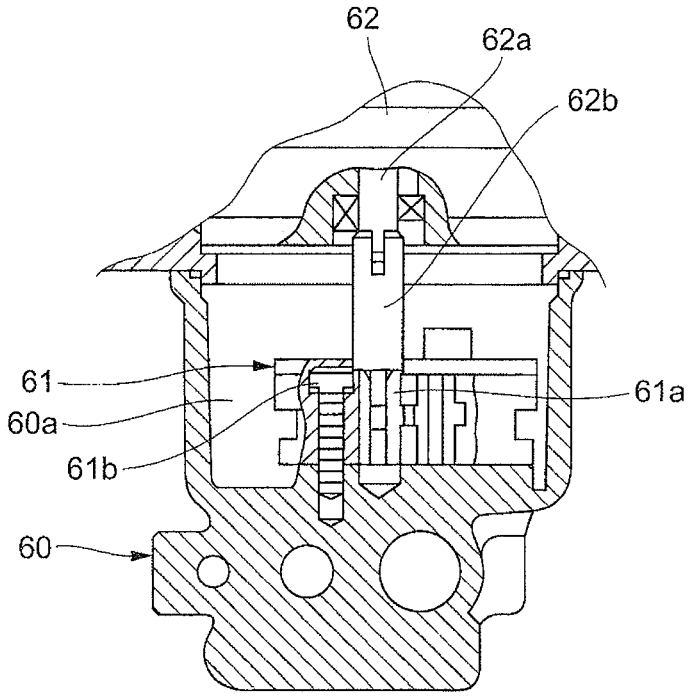
FIG. 6 is a cross-sectional view of a motor support portion.

FIG. 6 is a cross-sectional view of the motor support portion 60.

As illustrated in FIGS. 3 and 6, the supply and discharge device 32 includes a pump 61 that supplies hydraulic fluid in the cylinder 41 of the cylinder device 31, a motor 62 that drives the pump 61, and the motor support portion 60 that supports the motor 62. Moreover, the supply and discharge device 32 includes a tank chamber 63 that stores hydraulic fluid supplied to the pump 61 and the tank chamber support portion 64 that supports the tank chamber 63.

The motor support portion 60 is provided in the housing 310 so as to be adjacent to the cylinder 41 in the direction crossing the central line direction of the cylinder 41. The motor 62 is fixed to the other end side (the upper side in FIGS. 3 and 6) of the motor support portion 60 in the central line direction of the cylinder 41 by bolts. Moreover, a depression is formed in a portion of the motor support portion 60 located closer to one end side (the lower side in FIGS. 3 and 6) in the central line direction of the cylinder 41 than the portion to which the motor 62 is fixed, and this depression forms a pump chamber 60*a* that accommodates the pump 61. The pump chamber 60*a* stores hydraulic fluid and holds the pump 61 in a state where the pump 61 is immersed into the hydraulic fluid.

The pump 61 is a gear pump having a cassette pump structure, for example, and has a case that accommodates a gear unit including a drive gear and a driven gear. The pump 61 is fixed to the motor support portion 60 by a bolt 61*b* inside the pump chamber 60*a* so that a drive shaft 61*a* connected to the drive gear is aligned with an output shaft 62*a* of the motor 62. Moreover, the pump 61 can rotate in both forward and backward directions and has two discharge ports (not illustrated) for forward and backward rotation which are connected to a channel formed in the motor support portion 60 and two intake ports (not illustrated) for forward and backward rotation which are open to the pump chamber 60*a*.

The motor 62 has an iron yoke attached to the motor support portion 60 by bolts so as to be positioned above the pump chamber 60*a*. The output shaft 62*a* of the motor 62 is connected to the drive shaft 61*a* of the pump 61 with a drive joint 62*b* interposed and rotates in both directions.

The tank chamber 63 is provided so as to be adjacent to the cylinder 41 in the direction crossing the central line direction of the cylinder 41. The motor support portion 60 allows the tank chamber 63 and the pump chamber 60*a* to communicate with each other.

Next, the hydraulic fluid channel formed in the trim and tilt device 30 will be described.

Figure 7:
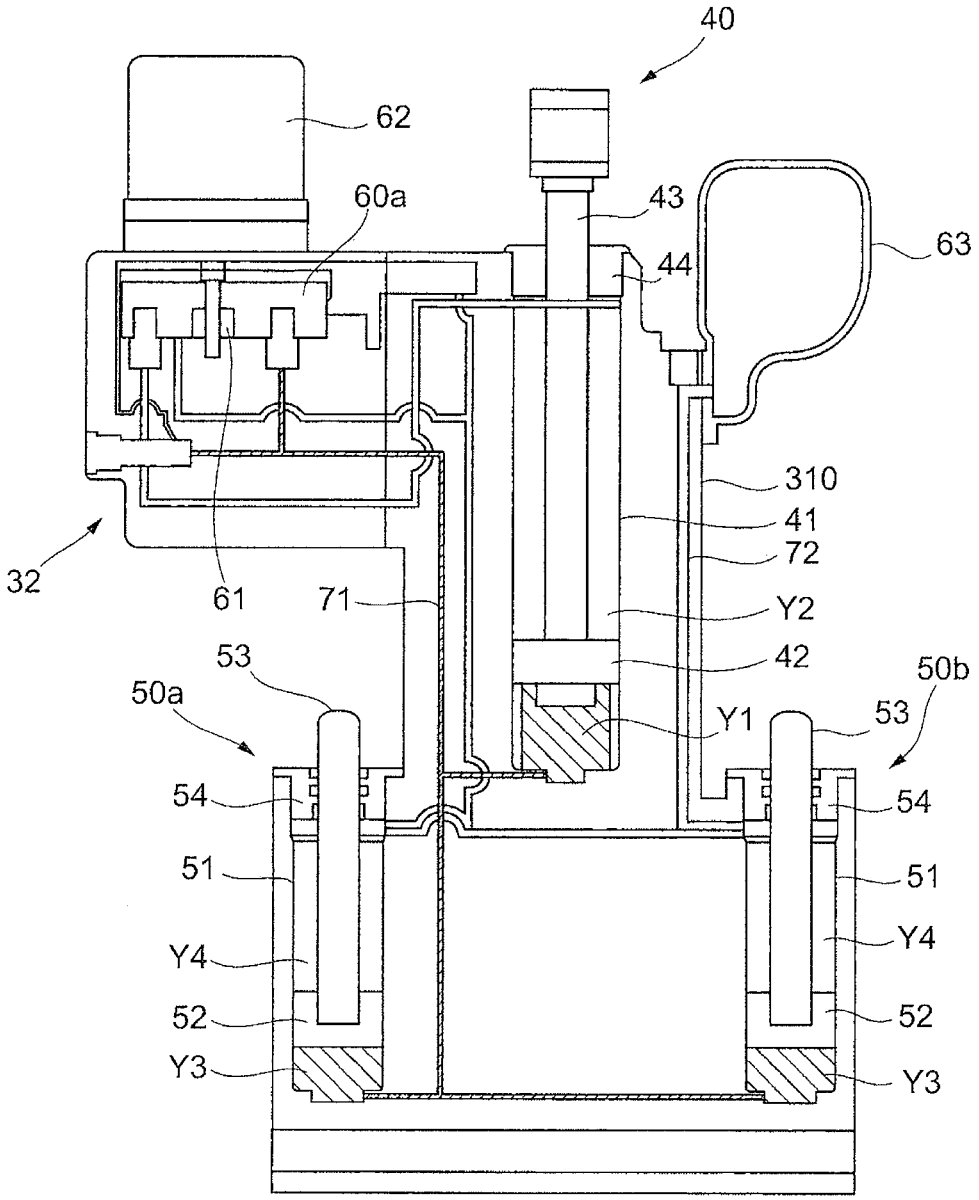
FIG. 7 is a conceptual diagram for describing the channel of a hydraulic fluid.

FIG. 7 is a conceptual diagram for describing the hydraulic fluid channel.

In the trim and tilt device 30, a first channel 71 that allows the first and second fluid chambers Y1 and Y3 and the pump chamber 60*a* to communicate with each other and a second channel 72 that allows the second and fourth fluid chambers Y2 and Y4 and the pump chamber 60*a* to communicate with each other are formed. The second channel 72 also communicates with the tank chamber 63 that stores the hydraulic fluid.

Figure 8:
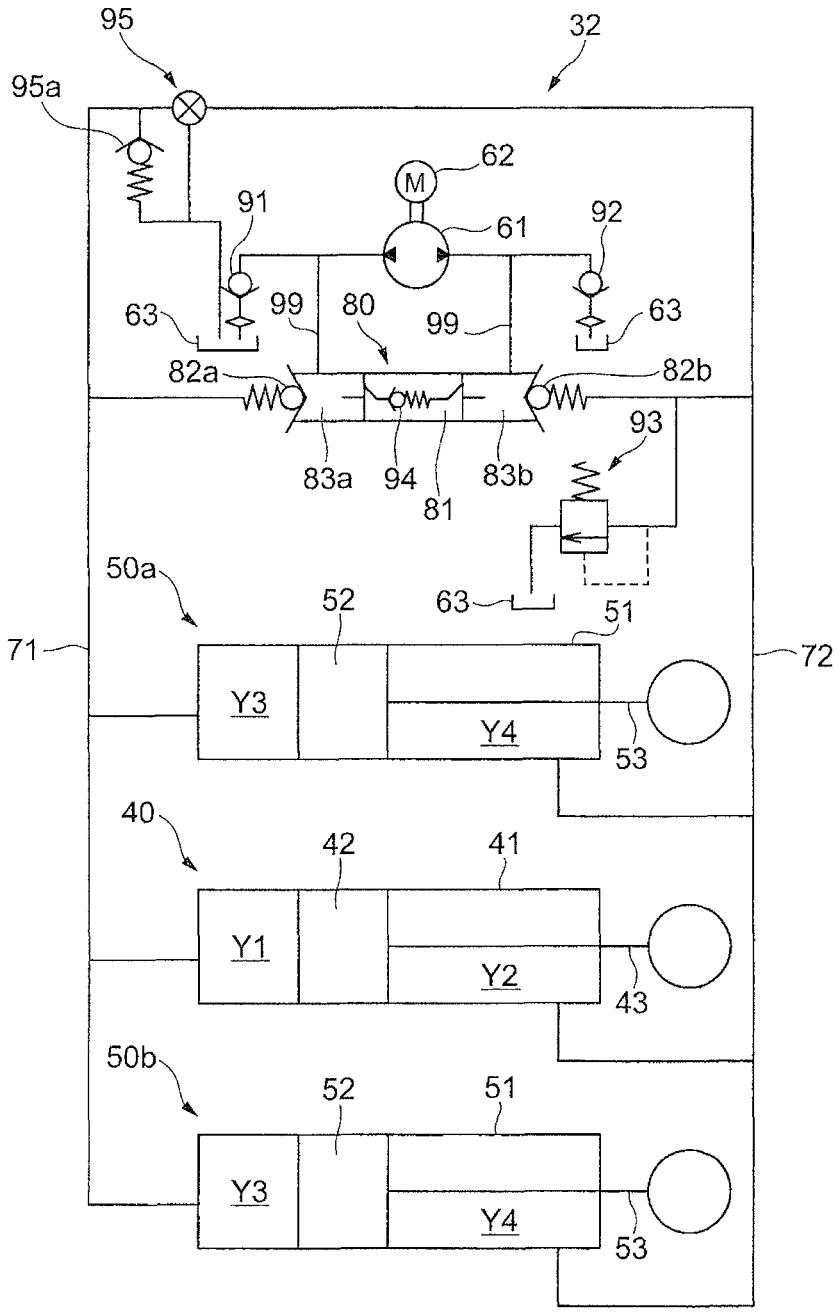
FIG. 8 is a schematic diagram illustrating a channel of a hydraulic fluid supplied and discharged by a supply and discharge device and an arrangement of valves provided on the channel.

FIG. 8 is a schematic diagram illustrating the channel of hydraulic fluid supplied and discharged by the supply and discharge device 32 and the arrangement of valves provided on the channel.

As illustrated in FIG. 8, the supply and discharge device includes a shuttle-type switching valve 80, backflow prevention valves 91 and 92, a compression-side relief valve 93, an extension-side relief valve 94, and a semi-manual thermal valve 95.

The shuttle-type switching valve 80 includes: a shuttle piston 81; and first and second check valves 82*a* and 82*b*, which are disposed on respective sides of the shuttle piston 81. In the shuttle-type switching valve 80, a first shuttle chamber 83*a* is formed in a portion of the shuttle piston 81 close to the first check valve 82*a*, and a second shuttle chamber 83*b* is formed in a portion of the shuttle piston 81 close to the second check valve 82*b*.

The first check valve 82*a* is configured to be able to open according to delivery pressure applied to the first shuttle chamber 83*a* via a pipeline 99 in response to forward rotation of the pump 61. The second check valve 82*b* is configured to be open according to delivery pressure applied to the second shuttle chamber 83*b* via the pipeline 99 in response to backward rotation of the pump 61. Moreover, the shuttle piston 81 is configured to open the second check valve 82*b* according to delivery pressure in response to forward rotation of the pump 61 and to open the first check valve 82*a* according to delivery pressure in response to backward rotation of the pump 61. The first check valve 82*a* of the shuttle-type switching valve 80 is connected to the first channel 71 and the second check valve 82*b* is connected to the second channel 72.

The backflow prevention valves 91 and 92 are disposed in an intermediate portion of a connection channel between the pump 61 and the tank chamber 63. The compression-side relief valve 93 is connected to the second channel 72 and the extension-side relief valve 94 is built in the shuttle piston 81. The semi-manual thermal valve 95 connects the first and third fluid chambers Y1 and Y3 to the tank chamber 63. The semi-manual thermal valve 95 includes a thermal relief valve 95*a* and releases circuit pressure to the tank chamber 63 with predetermined pressure when the pressure of hydraulic fluid in the cylinder 41 or 51 rises abnormally due to heat or the like.

Next, the operation of the trim and tilt device 30 will be described.

When the motor 62 rotates in the forward direction and the pump 61 rotates in the forward direction, the fluid discharged from the pump 61 opens the first check valve 82*a* of the shuttle-type switching valve 80 and opens the second check valve 82*b* with the aid of the shuttle piston 81. In this way, the fluid discharged from the pump 61 is supplied to the first and third fluid chambers Y1 and Y3 of the cylinder device 31 through the first check valve 82*a* and the first channel 71, and the hydraulic fluid in the second and fourth fluid chambers Y2 and Y4 of the cylinder device 31 returns to the pump 61 through the second channel 72 and the second check valve 82*b* and extends the cylinder device 31. As a result, the tilt angle θ (see FIG. 2) increases.

During this operation of increasing the tilt angle θ, since the volume of the cylinders 41 and 51 increases by an amount corresponding to retraction of the piston rods 43 and 53, the amount of circulating hydraulic fluid becomes short. Thus, the backflow prevention valve 92 opens and the shortage in the amount of circulating hydraulic fluid in the pump 61 is compensated from the tank chamber 63. Moreover, during the operation of increasing the tilt angle θ, when the pump 61 operates continuously and the circuit pressure is higher than predetermined pressure after the piston 42 reaches its maximum extension position and the operation of increasing the tilt angle θ ends, the extension-side relief valve 94 opens and the circuit pressure is released to the intake side of the pump 61.

On the other hand, when the motor 62 rotates in the backward direction and the pump 61 rotates in the backward direction, the fluid discharged from the pump 61 opens the second check valve 82*b* of the shuttle-type switching valve 80 and opens the first check valve 82*a* with the aid of the shuttle piston 81. In this way, the fluid discharged from the pump 61 is supplied to the second and fourth fluid chambers Y2 and Y4 of the cylinder device 31 through the second check valve 82*b* and the second channel 72, and the hydraulic fluid in the first and third fluid chambers Y1 and Y3 of the cylinder device 31 returns to the pump 61 through the first channel 71 and the first check valve 82*a* to compress the cylinder device 31. As a result, the tilt angle θ decreases.

During this operation of decreasing the tilt angle θ, since the volume of the cylinders 41 and 51 decreases by an amount corresponding to advancing of the piston rods 43 and 53, there is an excess amount of circulating hydraulic fluid. Thus, the compression-side relief valve 93 opens and the excess amount of circulating fluid is returned to the tank chamber 63. Moreover, when the pump 61 operates even after the piston 42 or 52 reaches its maximum compression position, the operation of decreasing the tilt angle θ ends, and there is no fluid returning to the pump 61 from the first and third fluid chambers Y1 and Y3, the backflow prevention valve 91 opens and hydraulic fluid can be supplied from the tank chamber 63. Moreover, when the pump 61 operates continuously and the circuit pressure is higher than predetermined pressure after the operation of decreasing the tilt angle θ ends, the compression-side relief valve 93 opens and the circuit pressure is released to the tank chamber 63.

When the cylinder device 31 is compressed manually, since the semi-manual thermal valve 95 opens, and the tilt angle θ could be decreased.

In this case, during the operation of increasing the tilt angle θ, in the trim area (in a range of tilt angles θ0 to θ1 in FIG. 2), the marine vessel propelling machine body 20*a* is raised according to the force generated by both the piston rod 43 and the piston rod 53. Specifically, the force generated by the extension of the piston rod 43 presses the swivel case (see FIG. 2) through the pin hole 43*b* (see FIG. 4). Moreover, in the trim area, the other end of the piston rod 53 in the central line direction is in contact with the marine vessel propelling machine body 20*a*, and the force generated by the extension of the piston rod 53 directly presses the marine vessel propelling machine body 20*a*. Due to this, the marine vessel propelling machine body 20*a* is raised.

Moreover, in the tilt area (in a range of tilt angles θ1 to θ2 in FIG. 2), the marine vessel propelling machine body 20*a* is raised by the force generated from the piston rod 43 only. Specifically, the force generated by the extension of the piston rod 43 is generated continuously in the tilt area. Due to this, the marine vessel propelling machine body 20*a* can be raised also in the tilt area as in the trim area. In contrast, when the tilt angle is θ1, the piston 52 (see FIG. 5) comes into contact with the rod guide 54 (see FIG. 5), and the piston rod 53 cannot extend further from this position (the maximum extension position). Due to this, in the tilt area, the piston rod 53 and the marine vessel propelling machine body 20*a* are not in contact but are separated from each other, and the piston rod 53 does not generate the force of raising the marine vessel propelling machine body 20*a*.

The operation of decreasing the tilt angle θ is opposite to the above-described operation. That is, in the tilt area, the marine vessel propelling machine body 20*a* is lowered while being supported by the contracting piston rod 43. Moreover, in the trim area, the marine vessel propelling machine body 20*a* is lowered while being supported by the contracting piston rods 43 and 53.

In this manner, the piston rod 43 moves in the axial direction of the cylinder 41 together with the piston 42 in a relative manner to thereby adjust the tilt angle θ of the marine vessel propelling machine body 20*a* with respect to the hull 2. Moreover, the piston rod 53 moves in the axial direction of the cylinder 51 together with the piston 52 in a relative manner to thereby adjust the tilt angle θ of the marine vessel propelling machine body 20*a* with respect to the hull 2.

Next, a conductive path formed in the marine vessel propelling machine 20 will be described.

As described in FIG. 2, the sacrificial anode 27 is electrically connected to the respective portions of the marine vessel propelling machine 20. In the trim and tilt device 30 illustrated in FIG. 3, the housing 310 is electrically connected to the sacrificial anode 27. Further, the housing 310, the rod guide body 44*a*, and the rod guide body 54*a* are electrically connected. That is, the housing 310, the rod guide body 44*a*, and the rod guide body 54*a* have conductive properties because these components are formed from aluminum alloys or the like. With the housing 310 and the rod guide body 44*a*, as well as the housing 310 and the rod guide body 54*a* being in direct contact, electrically connection therebetween is implemented.

Further, in the present embodiment, the rod guide body 44*a* and the piston rod 43 are electrically connected by the bearing 44*d*. Moreover, the rod guide body 54*a* and the piston rod 53 are electrically connected by the bearing 54*d*.

The piston rod 43 is formed from stainless material such as SUS304, and the rod guide body 44*a* and the piston rod 43 are in direct contact because the piston rod 43 is press-fitted to the rod guide body 44*a*. However, since this portion of the rod guide body 44*a* is anodized, even if these portions are in direct contact, electrical connection therebetween is not established. Thus, in the present embodiment, the conductive bearing 44*d* is provided so that the rod guide body 44*a* and the piston rod 43 are conductive and electrically connected.

This applies to the connection between the rod guide body 54*a* and the piston rod 53, hence the bearing 54*d* is provided so that the rod guide body 54*a* and the piston rod 53 are conductive and electrically connected.

Conventionally, since the bearing 44*d* or the bearing 54*d* is not provided, the rod guide body 44*a* and the piston rod 43 are not electrically connected, and the rod guide body 54*a* and the piston rod 53 are not electrically connected. Thus, the piston rod 43 or the piston rod 53 is not electrically connected to the sacrificial anode 27, and electric corrosion is likely to occur.

In the present embodiment, the bearing 44*d* or the bearing 54*d* is provided so that the piston rod 43 and the piston rod 53 are electrically connected to the sacrificial anode 27 and the occurrence of electric corrosion in the piston rod 43 or the piston rod 53 is suppressed.

In this manner, in the present embodiment, the sacrificial anode 27 is electrically connected to the piston rods 43 and 53 with a simple configuration of providing the bearing 44*d* or 54*d*.

When the piston rods 43 and 53 are extended and compressed, large frictional force is generated between the piston rod 43 and the bearing 44*d* and between the piston rod 53 and the bearing 54*d*. As thus explained, a material having conductive properties and excellent abrasion resistance is preferably used for the bearings 44*d* and 54*d*.

Specifically, carbon steel tubes for machine structures (STKM) can be used for the bearings 44*d* and 54*d*. Moreover, in order to improve abrasion resistance, the surface of the bearings 44*d* and 54*d* is preferably subjected to a copper alloy sintering process of sintering copper alloy powder and bonding the powder to the surface.

<Second Embodiment>

In the example described in FIG. 3 and other figures, although the cylinder device 31 of the trim and tilt device 30 includes the tilt cylinder mechanism 40 and the trim cylinder mechanism 50 separately, a cylinder device 31 in which the mechanisms are integrated may be used.

Figure 9:
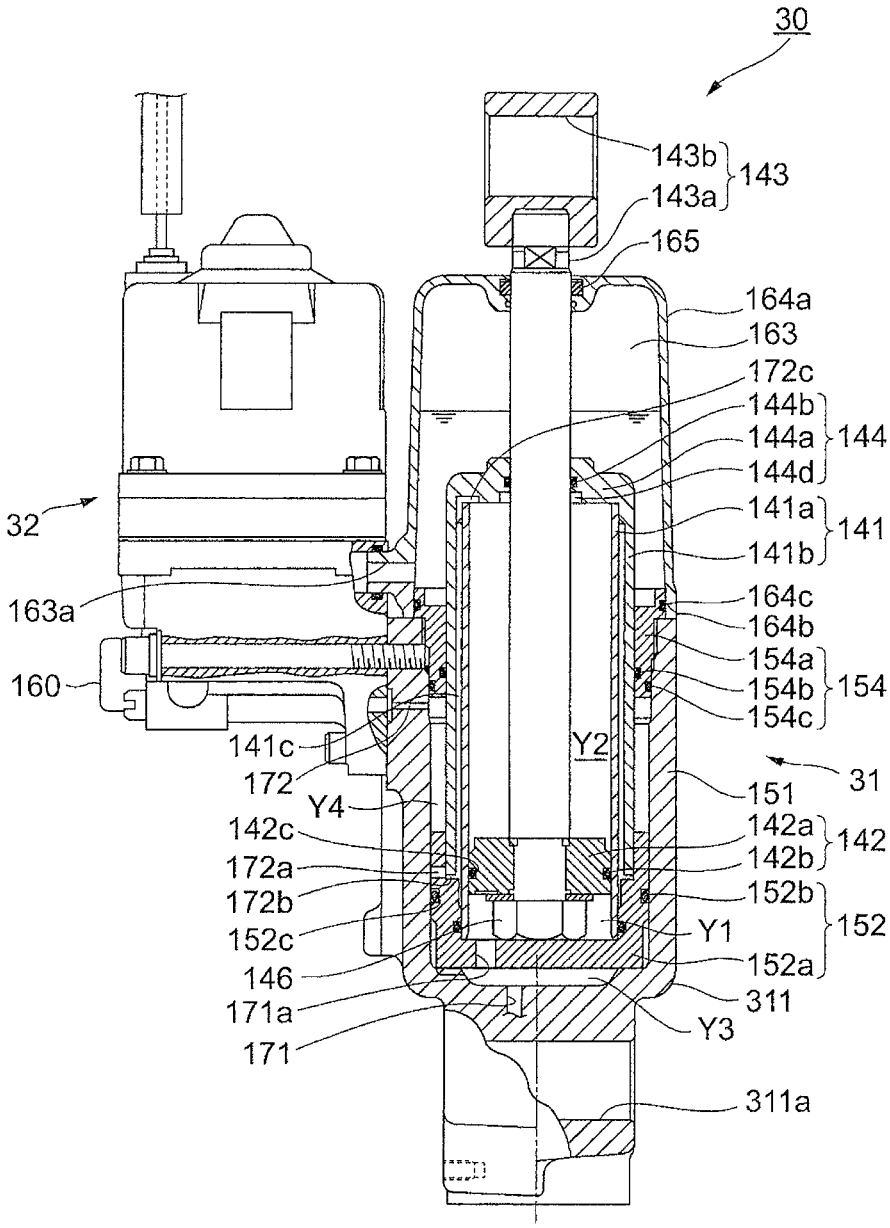
FIG. 9 is a diagram for describing a trim and tilt device according to a second embodiment.

FIG. 9 is a diagram for describing the trim and tilt device 30 of a second embodiment.

The trim and tilt device 30 illustrated includes the cylinder device 31 that is connected between the swivel case and the stern bracket 26 so as to be extended and compressed in order to change the distance therebetween and the supply and discharge device 32 that circulates hydraulic fluid in order to extend and compress the cylinder device 31 similarly to that illustrated FIG. 3.

The cylinder device 31 is a cylindrical portion formed in a housing 311. The cylinder device 31 includes a bottomed cylinder 151 of which one end in the central line direction (the up-down direction in FIG. 9) of the cylindrical portion is blocked and which has an opening at the other end, and a piston 152 inserted in the cylinder 151 so as to be movable in the central line direction.

The piston 152 includes a cylindrical piston body 152*a* and a sealing member 152*b* such as an O-ring provided on the outer circumference of the piston body 152*a*. A groove 152*c* depressed from the outer circumferential surface is formed on the entire outer circumference of the piston body 152*a*, and the sealing member 152*b* is fitted into the groove 152*c*. The piston 152 makes contact with the inner circumferential surface of the cylinder 151 and partitions an inner space of the cylinder 151 in which the hydraulic fluid is enclosed into a third fluid chamber Y3 that is disposed closer to one end side in the central line direction than the piston 152 and a fourth fluid chamber Y4 that is disposed closer to the other end side in the central line direction than the piston 152.

Moreover, the cylinder device 31 includes a bottomed cylinder 141, a piston 142 inserted in the cylinder 141 so as to be movable in the central line direction, and a piston rod 143 which extends in the central line direction and to which the piston 142 is attached on one end side (the lower end in FIG. 9) in the central line direction. Further, the cylinder device 31 includes a nut 146 that supports the piston 142 together with a male screw formed at one end of the piston rod 143 and a rod guide 144 disposed on the other end side of the cylinder 141 so as to guide the piston rod 143.

The cylinder 141 has a dual cylinder structure and includes an inner cylinder portion 141*a* and an outer cylinder portion 141*b*. Moreover, the other end of the outer cylinder portion 141*b* of the cylinder 141 is integrated with the rod guide 144. Due to this, the outer cylinder portion 141*b* has a bottomed cylindrical shape of which the other end is blocked and which has an opening at one end. On the other hand, the other end of the inner cylinder portion 141*a* is fitted into a recess formed on one end side of the rod guide 144. Moreover, ends on one side of the inner cylinder portion 141*a* and the outer cylinder portion 141*b* are fitted into a concave formed on the other end side of the piston 152.

The piston 142 includes a cylindrical piston body 142*a* in which a hole is formed at a central portion so that the piston rod 143 passes through the hole and a sealing member 142*b* such as an O-ring provided on an outer circumference of the piston body 142*a*. A groove 142*c* depressed from an outer circumferential surface is formed on the entire outer circumference of the piston body 142*a*, and the sealing member 142*b* is fitted into the groove 142*c*. The piston 142 makes contact with the inner circumferential surface of the cylinder 141 and partitions an inner space of the cylinder 141 in which hydraulic fluid is enclosed into a first fluid chamber Y1 that is disposed closer to one end side in the central line direction than the piston 142 and a second fluid chamber Y2 that is disposed closer to the other end side in the central line direction than the piston 142. The piston 142 functions as an example of a partition member that is provided in contact with the cylinder 141 so as to be movable in the axial direction (central line direction) of the cylinder 141 to partition the inner space of the cylinder 141.

The piston rod 143 is an example of a rod member and includes a columnar rod portion 143*a*, a male screw formed at one end in the central line direction of the piston rod 143 so as to attach the piston 142 thereto, and a pin hole 143*b* that supports a pin for connecting the piston rod 143 to the swivel case 25 is formed at the other end in the central line direction of the piston rod 143.

The rod guide 144 is an example of a rod guide member and includes an approximately cylindrical rod guide body 144*a* in which a hole is formed in a central portion so that the piston rod 143 passes through the hole, a sealing member 144*b* disposed in a central portion in the central line direction so as to make sliding contact with the piston rod 143, and a bearing 144*d* which is an example of a conductive portion and is a conductive annular bush and which supports the piston rod 143.

A groove depressed from an inner circumferential surface is formed in the inner circumference of the rod guide body 144*a*, and the sealing member 144*b* is fitted into the groove. Moreover, a recess depressed from one end in the central line direction of the rod guide body 144*a* is formed on the inner circumference of the rod guide body 144*a*, and the bearing 144*d* is fitted into the recess. In this manner, the bearing 144*d* is disposed at a position where the hole of the rod guide 144 is formed. The bearing 144*d* has the same configuration as that of the bearing 44*d* or 54*d*.

A cylinder guide 154 is disposed between the cylinders 141 and 151. The cylinder guide 154 includes a ring-shaped cylinder guide body 154*a*, a sealing member 154*b* such as an O-ring provided on the inner circumference of the cylinder guide body 154*a*, and a sealing member 154*c* such as an O-ring provided on the outer circumference of the cylinder guide body 154*a*. A groove depressed from the inner circumferential surface is formed on the entire inner circumference of the cylinder guide 154, and a groove depressed from the outer circumferential surface is formed on the entire outer circumference of the cylinder guide 154. The sealing members 154*b* and 154*c* are fitted into the respective grooves.

The cylinder device 31 includes a tank chamber 163 that is formed so as to cover the cylinder 141 and to store hydraulic fluid. The tank chamber 163 is formed as a space between the cylinder 141 and a tank housing 164*a* disposed to be fitted into the cylinder guide 154. A sealing member 164*c* such as an O-ring is provided between the cylinder guide 154 and a flange portion 164*b* at the lower end of the tank housing 164*a*, and the tank housing 164*a* is liquid-tightly fastened to the housing 311 by bolts with the sealing member 164*c* interposed.

Moreover, a hole is formed on the other end side of the tank housing 164*a* so that the piston rod 143 passes through the hole, and a sealing member 165 such as an oil seal that allows the piston rod 143 to slide in a liquid-tight manner is provided in the hole.

The housing 311 includes the cylinder 141 and the motor support portion 160 in an integrated manner. A channel which is a flow path of hydraulic fluid is formed around the cylinders 141 and 151, which will be described in detail later. A pin hole 311*a* that supports a pin for connecting the trim and tilt device 30 to the stern bracket 26 is formed at one end of the housing 311 in the central line direction of the cylinders 141 and 151.

The supply and discharge device 32 has the same configuration as that described in FIG. 6. However, the hydraulic fluid channel has the following configuration.

In the trim and tilt device 30, a first channel 171 that allows the first and third fluid chambers Y1 and Y3 and the pump chamber 60*a* (see FIG. 6) to communicate with each other and a second channel 172 that allows the second and fourth fluid chambers Y2 and Y4 and the pump chamber 60*a* to communicate with each other are formed. The second channel 172 also communicates with the tank chamber 163 that stores hydraulic fluid through a communication hole 163*a*.

The piston 152 has a communication path 171*a* having a through-hole shape which is formed in the piston body 152*a* so as to allow the first and third fluid chambers Y1 and Y3 to communicate with each other. The first fluid chamber Y1 communicates with the pump chamber 60*a*. Due to this, the first channel 171 that allows the first and third fluid chambers Y1 and Y3 and the pump chamber 60*a* to communicate with each other is formed.

Moreover, a communication path 141*c* is formed between the inner cylinder portion 141*a* and the outer cylinder portion 141*b*, and the communication path 141*c* communicates with the second fluid chamber Y2 through a communication path 172*c*. Further, the communication path 141*c* communicates with the fourth fluid chamber Y4 through communication paths 172*a* and 172*b*. Further, the fourth fluid chamber Y4 communicates with the pump chamber 60*a*. Due to this, the second channel 172 that allows the second and fourth fluid chambers Y2 and Y4 and the pump chamber 60*a* to communicate with each other is formed.

Figure 10:
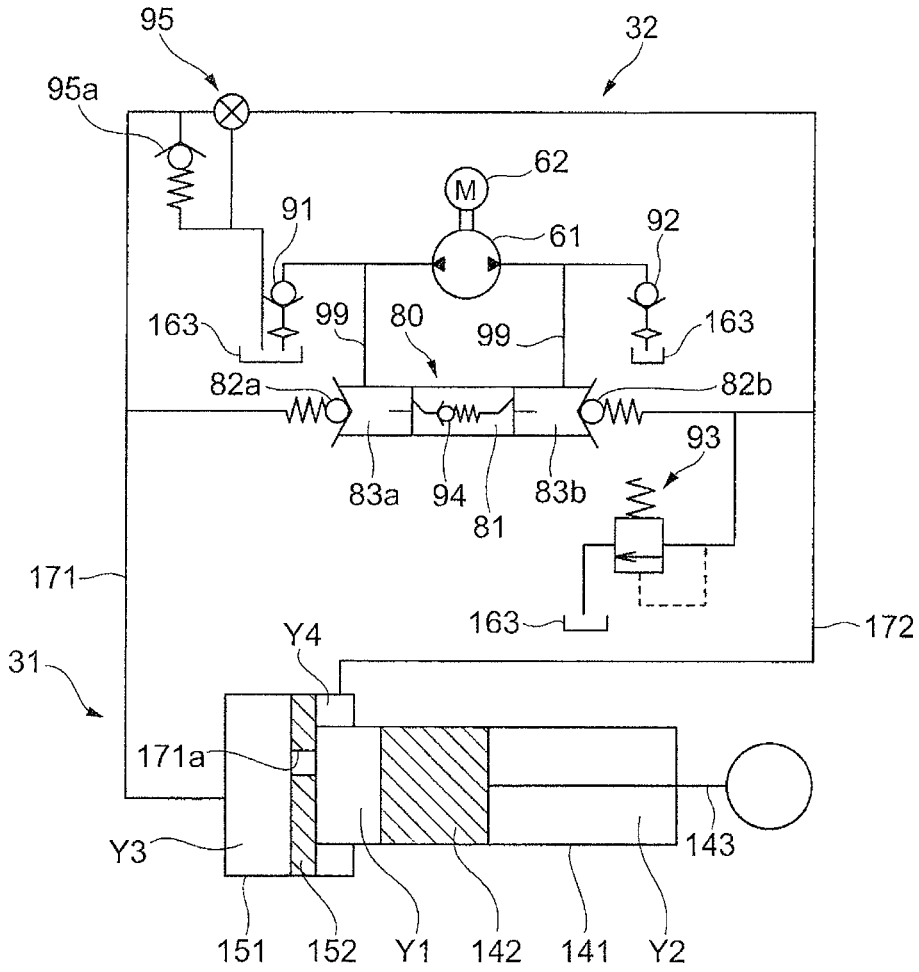
FIG. 10 is a schematic diagram illustrating a channel of a hydraulic fluid supplied and discharged by a supply and discharge device illustrated in FIG. 9 and an arrangement of valves provided on the channel.

FIG. 10 is a schematic diagram illustrating the channel of hydraulic fluid supplied and discharged by the supply and discharge device 32 illustrated in FIG. 9 and an arrangement of valves provided on the channel.

The supply and discharge device 32 illustrated in FIG. 10 has the same configuration as that of the supply and discharge device 32 illustrated in FIG. 8 with regard to the arrangement of valves provided on the channel. On the other hand, the configuration of the first, second, third, and fourth fluid chambers Y1, Y2, Y3, and Y4 connected to the first and second channels 171 and 172 corresponds to the configuration illustrated in FIG. 9.

Hereinafter, the operation of the trim and tilt device 30 will be described with reference to FIGS. 9 and 10. In the state illustrated in FIG. 9, the tilt angle θ is in the state of the tilt angle $\theta_0$ in FIG. 2.

When the motor 62 rotates in the forward direction and the pump 61 rotates in the forward direction from the state illustrated in FIG. 9, the fluid discharged from the pump 61 opens the first check valve 82*a* of the shuttle-type switching valve 80 and opens the second check valve 82*b* with the aid of the shuttle piston 81. In this way, the fluid discharged from the pump 61 is supplied to the third fluid chamber Y3 of the cylinder device 31 through the first check valve 82*a* and the first channel 171. Moreover, the hydraulic fluid in the fourth fluid chamber Y4 of the cylinder device 31 returns to the pump 61 through the second channel 172 and the second check valve 82*b*, and as a result, the piston 152 is pushed up. Further, as illustrated in FIG. 9, since the piston 152 and the nut 146 are in contact with each other, the piston rod 143 is pushed up, and the tilt angle θ (see FIG. 2) increases.

In this case, the hydraulic fluid acts on the piston 142 of the first fluid chamber Y1 through the communication path 171*a*. However, as illustrated in the drawing, the piston 142 has a smaller diameter than the piston 152, a pressure-receiving area thereof is small. Thus, the piston 152 having a larger diameter and a larger pressure-receiving area than the piston 142 is pushed up preferentially, and the piston 142 is not moved.

Figure 11:
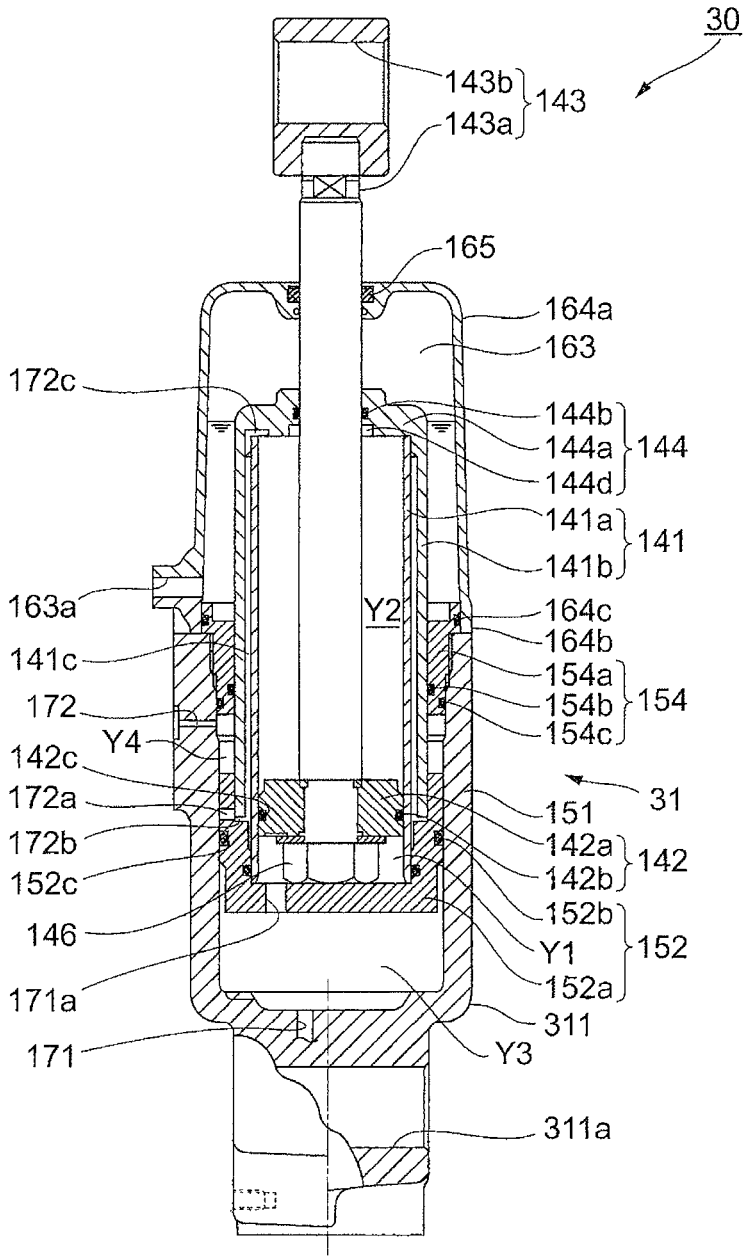
FIG. 11 is a diagram for describing the state of the trim and tilt device at a tilt angle of $\theta_1$.

However, the distance that the piston 152 moves in each stroke is shorter than the distance the piston 142 moves in each stroke. When the piston 152 is at a stroke end, the piston 152 cannot move further upward from the position. This state is illustrated in FIG. 11. In this case, the tilt angle θ is in the state of the tilt angle $\theta_1$ in FIG. 2. That is, the piston 152 operates in the trim area.

Figure 12:
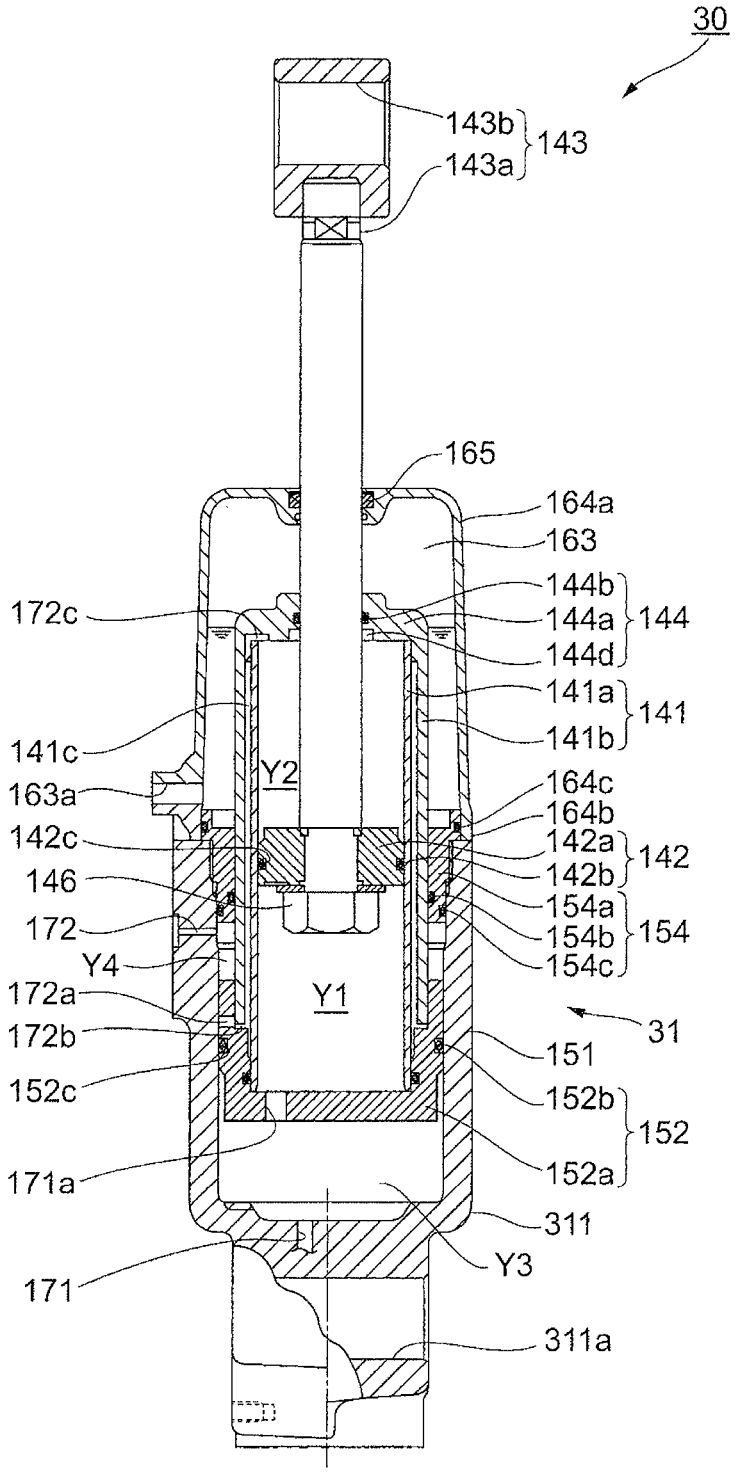
FIG. 12 is a diagram for describing the state of the trim and tilt device at a tilt angle of $\theta_2$.

When the pump 61 is operated further, hydraulic fluid acts on the piston 142 of the first fluid chamber Y1 whereby the piston 142 is pushed up. As a result, the piston rod 143 is pushed up and the tilt angle θ increases further. This occurs continuously until the piston 142 reaches a stroke end and becomes unmovable. This state is illustrated in FIG. 12. In this case, the tilt angle θ is in the state of the tilt angle $\theta_2$ in FIG. 2. That is, the piston 142 operates in the tilt area.

During this operation of increasing the tilt angle θ, since the volume of the cylinders 141 and 151 increases by an amount corresponding to retraction of the piston rod 143, the amount of circulating hydraulic fluid becomes short. Thus, the backflow prevention valve 92 opens and the shortage in the amount of circulating hydraulic fluid in the pump 61 is compensated from the tank chamber 163. Moreover, during the operation of increasing the tilt angle θ, when the pump 61 operates continuously and the circuit pressure is higher than predetermined pressure after the piston 142 reaches its maximum extension position and the operation of increasing the tilt angle θ ends, the extension-side relief valve 94 opens and the circuit pressure is released to the intake side of the pump 61.

On the other hand, when the motor 62 rotates in the backward direction and the pump 61 rotates in the backward direction, the fluid discharged from the pump 61 opens the second check valve 82*b* of the shuttle-type switching valve 80 and opens the first check valve 82*a* with the aid of the shuttle piston 81. In this way, the fluid discharged from the pump 61 is supplied to the second and fourth fluid chambers Y2 and Y4 of the cylinder device 31 through the second check valve 82*b* and the second channel 172, and the hydraulic fluid in the first and third fluid chambers Y1 and Y3 of the cylinder device 31 returns to the pump 61 through the first channel 171 and the first check valve 82*a* to compress the cylinder device 31. As a result, by the operation opposite to the above-described operation, the pistons 142 and 152 and the piston rod 143 operate, and the tilt angle θ decreases.

During this operation of decreasing the tilt angle θ, since the volume of the cylinders 141 and 151 decreases by an amount corresponding to advancing of the piston rod 143, there is an excess amount of circulating hydraulic fluid. Thus, the compression-side relief valve 93 opens and the excess amount of circulating fluid is returned to the tank chamber 163. Moreover, when the pump 61 operates even after the piston 142 or 152 reaches its maximum compression position, the operation of decreasing the tilt angle θ ends, and there is no fluid returning to the pump 61 from the first and third fluid chambers Y1 and Y3, the backflow prevention valve 91 opens and hydraulic fluid can be supplied from the tank chamber 163. Moreover, when the pump 61 operates continuously and the circuit pressure is higher than predetermined pressure after the operation of decreasing the tilt angle θ ends, the compression-side relief valve 93 opens and the circuit pressure is released to the tank chamber 163.

When the cylinder device 31 is compressed manually, since the semi-manual thermal valve 95 opens, and the tilt angle θ could be decreased.

What is claimed is:

1. A trim and tilt device comprising:

a cylindrical cylinder;

a partition member provided in contact with the cylinder so as to be movable in an axial direction of the cylinder and partitioning a space inside the cylinder;

a rod member to which the partition member is attached on one end side of the rod member and which moves relatively in the axial direction of the cylinder together with the partition member thereby adjusting a tilt angle of a marine vessel propelling machine body with respect to a hull; and a rod guide member electrically connected to a sacrificial anode and having a hole so that the rod member passes through the hole, wherein the rod guide member includes a conductive portion comprising a bearing that supports the rod member and is disposed at a position, where the hole is formed, so as to electrically connect the rod member and the rod guide member.

2. A marine vessel propelling machine comprising:

a marine vessel propelling machine body having a propeller;

a sacrificial anode; and a trim and tilt device comprising a cylindrical cylinder; a partition member provided in contact with the cylinder so as to be movable in an axial direction of the cylinder and partitioning a space inside the cylinder; a rod member to which the partition member is attached on one end side of the rod member and which moves relatively in the axial direction of the cylinder together with the partition member thereby adjusting a tilt angle of the marine vessel propelling machine body with respect to a hull; and a rod guide member having a hole so that the rod member passes through the hole, wherein the rod guide member of the trim and tilt device includes a conductive portion comprising a bearing that supports the rod member and is disposed at a position where the hole is formed so as to electrically connect the rod member, the rod guide member and the sacrificial anode.

3. The trim and tilt device of claim 1, wherein the hole is formed through a body of the rod guide member and the bearing is disposed internally within the hole and contacts the rod member which passes through an opening formed in the bearing.

4. The marine vessel propelling machine of claim 2, wherein the hole is formed through a body of the rod guide member and the bearing is disposed internally within the hole and contacts the rod member which passes though an opening formed in the bearing.

5. The trim and tilt device of claim 3, wherein the body of the rod guide member circumferentially surrounds the bearing.

6. The marine vessel propelling machine of claim 4, wherein the body of the rod guide member circumferentially surrounds the bearing.

* * * * *